US010767389B2

(12) United States Patent
Goldstein

(10) Patent No.: US 10,767,389 B2
(45) **Date of Patent: *Sep. 8, 2020**

(54) BRIDGE ADAPTER

(71) Applicant: Steven M. Goldstein, Herald, CA (US)

(72) Inventor: Steven M. Goldstein, Herald, CA (US)

( * ) Notice: Subject to any disclaimer, the term of this patent is extended or adjusted under 35 U.S.C. 154(b) by 915 days.

This patent is subject to a terminal disclaimer.

(21) Appl. No.: 15/401,104

(22) Filed: Jan. 9, 2017

(65) Prior Publication Data

US 2018/0195313 A1 Jul. 12, 2018

(51) Int. Cl.
*E05B 17/06* (2006.01)
*E05B 63/08* (2006.01)
*E05B 9/08* (2006.01)

(52) U.S. Cl.
CPC ..... *E05B 17/06* (2013.01); *E05B 9/08* (2013.01); *E05B 63/08* (2013.01)

(58) Field of Classification Search
CPC ..... E05B 17/06; E05B 63/08; E05B 9/08
USPC ..... 292/288, 307 R, 1, 341.8; 52/3, 52/455–458, 656.1–656.9; 70/450
See application file for complete search history.

(56) References Cited

U.S. PATENT DOCUMENTS 1,533,343 A * 4/1925 Segal ..... E05B 17/06 70/379 R
6,277,454 B1 * 8/2001 Neale ..... B65D 81/3823 220/592.22
2008/0236002 A1 * 10/2008 Virvo ..... A47F 5/112 40/312
2012/0300437 A1 * 11/2012 Lu ..... F21V 21/005 362/147
2013/0345626 A1 * 12/2013 Tennican ..... A61M 5/002 604/89
2017/0007044 A1 * 1/2017 Gates ..... A47G 1/0638
2017/0105461 A1 * 4/2017 Hancock ..... A42B 3/127
2018/0371793 A1 * 12/2018 Goldstein ..... E05B 17/06

* cited by examiner

*Primary Examiner* — Kristina R Fulton
*Assistant Examiner* — Thomas L Neubauer
(74) *Attorney, Agent, or Firm* — Kali Law Group, P.C.

(57) ABSTRACT

Bridge adapters configured for insertion into a cavity within a door stile are presented, the bridge adapter including: a planar body including, a top plate disposed along a distal end of the planar body, a first side plate including a first side plate front edge and a first side plate back edge located opposite the first side plate front edge, where the first side plate is mechanically coupled along the first side plate front edge and the top plate back edge by a first hinge, a bottom plate including a bottom plate front edge and a bottom plate back edge located opposite a bottom plate front edge, where the bottom plate front edge is mechanically coupled along the first side plate back edge and the bottom plate front edge by a second hinge.

18 Claims, 5 Drawing Sheets

BRIDGE ADAPTER

FIELD OF INVENTION

The present invention relates generally to lock accessories, and more specifically to adapters for supporting mortise locks.

BACKGROUND

Mortise locks are widely used for commercial and residential applications. A mortise lock, unlike a cylinder lock, is installed in a cavity cut or defined within the door stile (a cylinder lock is installed in a hole cut through the door). After installation, the mortise lock body is contained completely in the cavity. Since the body size of a mortise lock is not standardized, the pre-cut or previously used cavity may not be properly sized to match a particular mortise lock. This is particularly true when locks are modernized or updated thus complicating lock installation.

In addition, in some installations, a user may desire to eliminate the mortise lock altogether and replace the mortise lock with a faceplate. In general, a faceplate must present a smooth surface along the door stile. Unfortunately, doors that previously included a mortise lock may lack a surface to which to attach the faceplate. In those instances, expensive replacement doors may be necessary.

As such bridge adapters are presented herein.

SUMMARY

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented below.

As such, bridge adapters configured for insertion into a cavity within a door stile are presented, the bridge adapter including: a planar body including, a top plate disposed along a distal end of the planar body, where the top plate includes a top plate front edge disposed along the distal end and a top plate back edge located opposite the top plate front edge, where the top plate further includes at least one raised feature along a top surface of the top plate, and where the top plate front edge includes a locking indent sized to couple with the raised locking feature, a first side plate including a first side plate front edge and a first side plate back edge located opposite the first side plate front edge, where the first side plate is mechanically coupled along the first side plate front edge and the top plate back edge by a first hinge, a bottom plate including a bottom plate front edge and a bottom plate back edge located opposite a bottom plate front edge, where the bottom plate front edge is mechanically coupled along the first side plate back edge and the bottom plate front edge by a second hinge, where the bottom plate includes at least one through hole sized to receive the at least one raised feature, and a second side plate including a second side plate front edge and a second side plate back edge located opposite the second side plate front edge, where the second side plate front edge is mechanically coupled along the bottom plate back edge and the second side plate front edge by a third hinge; and a tail including a first end and a second end, where the tail is mechanically and removably coupled along the second side plate back edge and the first end, where the tail further includes a raised locking feature, the locking feature disposed along the first end. In some embodiments, the planar body and the tail are made of a polymeric material and where the first hinge, second hinge, and third hinge are living hinges. In some embodiments, at least one plate includes at least one support rib disposed along an inner surface of the at least one plate. In some embodiments, the tail further includes a handle disposed along the second end. In some embodiments, the handle is curved. In some embodiments, the tail is flexible. In some embodiments, the tail is connected to the second side back edge by a perforated feature for detaching the tail. In some embodiments, the first hinge and second hinge have a range of motion of more than approximately 90 degrees and where the third hinge has a range of motion of at least approximately 120 degrees. In some embodiments, the third hinge has a range of motion of at least approximately 130 degrees. In some embodiments, the bottom plate is substantially the same width as the cavity, where at least one of the first side plate and the second side plate includes a friction-enhancing feature for engaging a wall of the cavity, and where the friction enhancing feature is raised and disposed along an outer surface of the bottom plate. In some embodiments, the second side plate includes a cutout sized to enable a tail to pass around the bridge adapter, where the cutout is disposed along an outer surface of the second side plate. In some embodiments, the top plate further includes a through hole centered with the top plate.

In other embodiments, methods of installing a first bridge adapter in a cavity are presented including: providing the first bridge adapter, where the first bridge adapter includes: a planar body including, a top plate disposed along a distal end of the planar body, where the top plate includes a top plate front edge disposed along the distal end and a top plate back edge located opposite the top plate front edge, where the top plate further includes at least one raised feature along a top surface of the top plate, and where the top plate front edge includes a locking indent, a first side plate including a first side plate front edge and a first side plate back edge located opposite the first side plate front edge, where the first side plate is mechanically coupled along the first side plate front edge and the top plate back edge by a first hinge, a bottom plate including a bottom plate front edge and a bottom plate back edge located opposite a bottom plate front edge, where the bottom plate front edge is mechanically coupled along the first side plate back edge and the bottom plate front edge by a second hinge, where the bottom plate includes at least one through hole sized to receive the at least one raised feature, and a second side plate including a second side plate front edge and a second side plate back edge located opposite the second side plate front edge, where the second side plate front edge is mechanically coupled along the bottom plate back edge and the second side plate front edge by a third hinge; and a tail including a first end and a second end, where the tail is mechanically and removably coupled along the second side plate back edge and the first end, where the tail further includes a raised locking feature sized to couple with the locking indent, the locking feature disposed along the first end; inserting the first bridge adapter into the cavity through the opening; bending the second hinge and third hinge of the first bridge adapter in such a way that the first side plate is in contact with a first wall of the cavity, the bottom plate is in contact with the bottom of the cavity, and the second side plate is in contact with a second wall of the cavity; and bending the first hinge of the first bridge adapter such that the locking indent engages with the raised locking feature.

BRIEF DESCRIPTION OF THE DRAWINGS

The present invention is illustrated by way of example, and not by way of limitation, in the figures of the accompanying drawings and in which like reference numerals refer to similar elements and in which.

DETAILED DESCRIPTION

The present invention will now be described in detail with reference to a few embodiments thereof as illustrated in the accompanying drawings. In the following description, numerous specific details are set forth in order to provide a thorough understanding of the present invention. It will be apparent, however, to one skilled in the art, that the present invention may be practiced without some or all of these specific details. In other instances, well known process steps and/or structures have not been described in detail in order to not unnecessarily obscure the present invention.

For purposes of the present disclosure, a "bridge adapter" is a spacer that can support a snap-in bridge that, in turn, may support a mortise lock or a faceplate. A "cavity" is a hollow space within a door stile. An "opening" is the opening to the cavity located on the surface of the door stile.

An object of the present invention is to provide a bridge adapter that can support a bridge which supports the body of a mortise lock or faceplate in a cavity that is too deep for the body of the mortise lock.

Another object of the present invention is to provide a bridge adapter that can be inserted into a cavity within the door stile, even when the opening of the cavity is smaller than the cavity itself.

One embodiment of the bridge adapter of the present invention is a body that, when folded, becomes a rectangular tube-shaped spacer that is strong enough to support the body of a mortise lock or faceplate. In embodiments, a tail coupled with the body may be used for insertion of the body into a door stile cavity. The body folds into the desired rectangular tube shape as it is pushed into the cavity.

Figure 1:
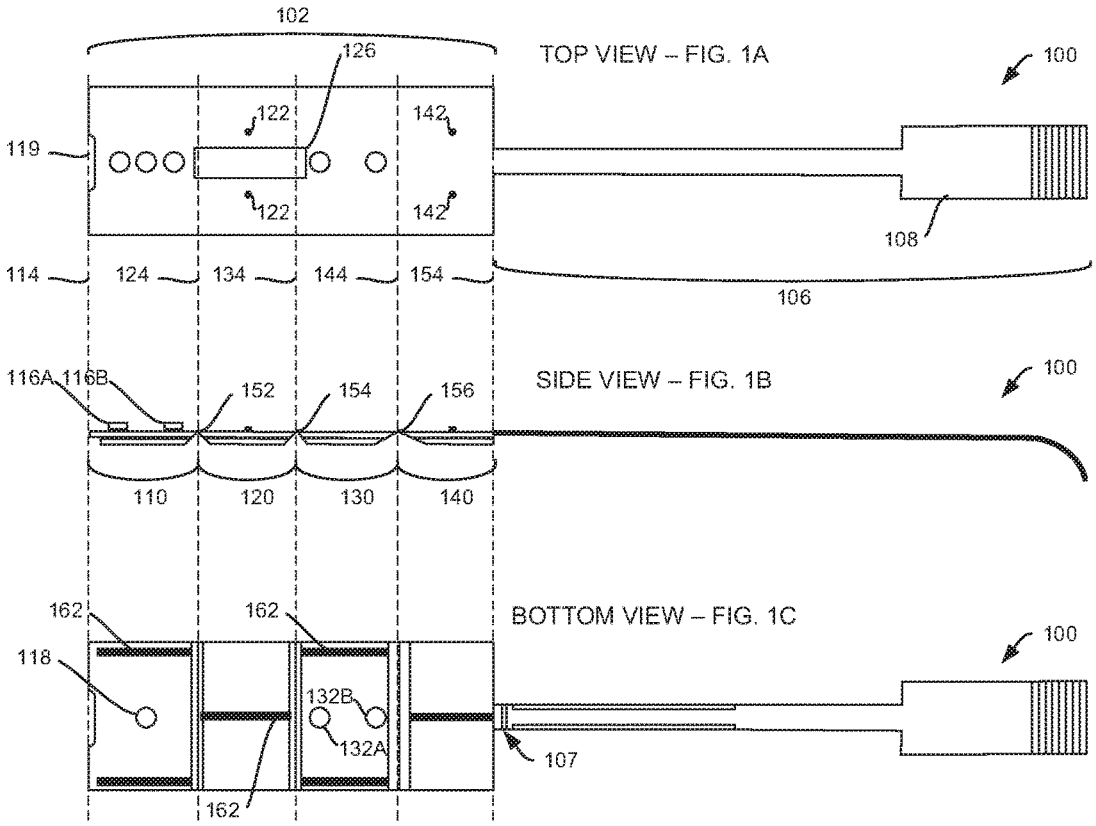
FIGS. 1A-1C are illustrative representations of various views of a bridge adapter in accordance with embodiments of the present invention.

FIG. 1 is an illustrative representation of various views of a bridge adapter in accordance with embodiments of the present invention. In particular, as illustrated in FIGS. 1A to 1C, bridge adapter 100 may include planar body 102 which may further include a number of features. For example, planar body 102 may include top plate 110, that is disposed along distal edge of planar body 102. Top plate 110 may be defined by top plate front edge as indicated by dashed line 114 disposed along a distal end and top plate back edge as indicated by dashed line 124 disposed opposite top plate front edge. The illustrated dashed lines are for clarity in defining the various plates presented across all views. Further illustrated are raised features 116A and 116B. Raised features 116A and 116B may be useful in stacking bridge adapter embodiments as will be discussed in further detail below for FIG. 4. In addition, top plate 110 may include a through hole 118, which may be smooth bore or threaded and centered with the top plate in embodiments. Still further illustrated is locking indent 119 sized to couple with raised locking feature 107.

Planar body 102 may additionally include first side plate 120, located proximally to top plate 110. First side plate 120 may be defined by the first side plate front edge as indicated by dashed line 124 disposed along a distal end and the first side plate back edge as indicated by 134 disposed opposite the first side plate front edge. The first side plate front edge may be connected with the top plate back edge by first hinge 152. In embodiments, first hinge 152 may have a range of motion of more than approximately 90 degrees. In one embodiment, a range of motion of the first hinge is approximately 93 degrees. First hinge 152 is preferably strong and capable of flexing without damage. In one embodiment, the first hinge is a living hinge. As known in the art, a living hinge is a thin flexible hinge (flexure bearing) made from the same material as the two rigid pieces it connects, rather than cloth, leather, or some other flexible substance. A living hinge is typically thinned, cut, or formed to allow the rigid pieces to bend along the line of the hinge. First side plate 120 may also include friction-enhancing features 122 which may assist in retaining the bridge adapter in the cavity by engaging with the walls of the cavity. In an embodiment, as illustrated in FIG. 1A, friction-enhancing feature 122 includes two raised bumps that may engage with the inner surface of the cavity. In some instances, the inner surface of the cavity may be irregular. Friction-enhancing raised feature embodiments may be useful to provide a secure mechanical connection with irregular or non-planar surfaces. Further illustrated is cutout 126 sized to enable a tail to pass around bridge adapter 100 when installed. In embodiments, cutout 126 may be disposed along an outer surface of second side plate 102. Cutout embodiments will be discussed in further detail below for FIG. 4.

Planar body 102 may also include bottom plate 130, located proximally to first side plate 120. Bottom plate 130 may be defined by bottom plate front edge as indicated by dashed line 134 disposed along a distal end and bottom plate back edge as indicated by dashed line 144 disposed opposite the bottom plate front edge. In an embodiment, a length from the bottom plate front edge to the bottom plate back edge may be substantially the same as a length from the top plate front edge to the top plate back edge. The bottom plate front edge may be connected with the first side plate back edge by second hinge 154. Second hinge 154 may have a range of motion of more than approximately 90 degrees. In one embodiment, the range of motion is approximately 93 degrees. Second hinge 154 is preferably strong and capable of flexing without damage. In an embodiment, the second hinge is a living hinge. Bottom plate 130 preferably also includes through holes 132A and 132B. The through holes may be arranged to engage with raised features 116A and 116B when two bridge adapter embodiments are stacked on top of each other within a cavity. Stacking is further elucidated below with respect to FIG. 4.

Planar body 102 may further include second side plate 140, located proximally to bottom plate 130. Second side plate 140 may be defined by second side plate front edge as indicated by dashed line 144 disposed along a distal end and second side plate back edge as indicated by dashed line 154 disposed opposite the second side plate front edge. The length from the second side plate front edge to the second side plate back edge is preferably the same as the length from the first side plate front edge to the first side plate back edge. The second side plate front edge may be mechanically coupled with the bottom plate back edge by third hinge 156. Third hinge 156 may be different from the first and second hinges in having a wider range of motion. In embodiments, third hinge may have a range of motion of at least approximately 120 degrees. In some embodiments, third hinge may have a range of motion of at least approximately 130 degrees. This wider range of motion may enable planar body 102 to flex in such a way as to clear the walls of the cavity during insertion. The third hinge is preferably strong and capable of repeated flexing without damage. In an embodiment, the third hinge is a living hinge. Second side plate 140 may also include friction-enhancing feature 142 which may assist in retaining the bridge adapter in the cavity by engaging with the walls of the cavity. In an embodiment, as illustrated in FIGS. 1A-1C, friction-enhancing feature 142 may include two raised bumps that may engage with the rough inner surface of the cavity.

Additionally, as illustrated in FIGS. 1A-1C, bridge adapter 100 may also include tail 106 that is disposed along the second side plate back edge. Tail 106 may include a handle 108 located at the opposite end of the tail from the second side plate back edge. The handle may be curved to enable easier grasping and may include textured features to improve friction between the hand and the handle. Tail 106 is attached to the second side plate back edge by a removable connection; the removable connection is preferably a living hinge that is perforated to enable easy detachment without displacing the bridge adapter from its position in the cavity. The tail also includes a locking feature 107 that engages with the locking indent 119 when the bridge adapter is folded, locking it into a rectangular tube shape. The tail is preferably thinner than the body and is preferably stiff enough to be used to push the body into the cavity. The length of the tail is preferably sufficient to reach the bottom of the cavity without having the handle enter the cavity.

In an embodiment, one or more of the plates may include one or more support ribs 162 disposed along inner surfaces of the one or more plates. Support ribs 162 may be separately located along each plate as illustrated and may strengthen the plates in order for the bridge adapter to avoid flexing during use. In an embodiment, support ribs may extend from the front edge to the back edge of each plate and may have at least one thickness of the plate in width and thickness. Each plate may include any number of ribs.

Figure 2A:
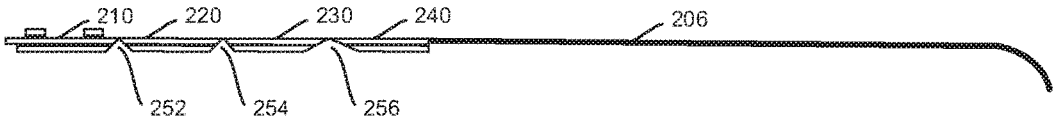
FIGS. 2A-2D are illustrative representations of side views of a bridge adapter in accordance with embodiments of the present invention in the process of folding.
Figure 2B:
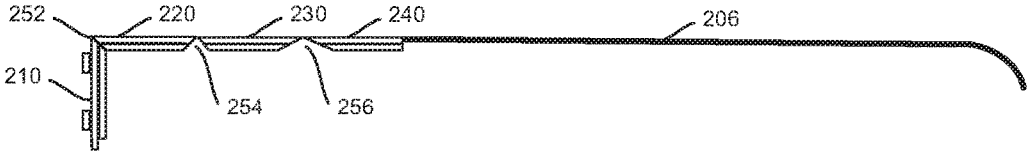
Figure 2C:
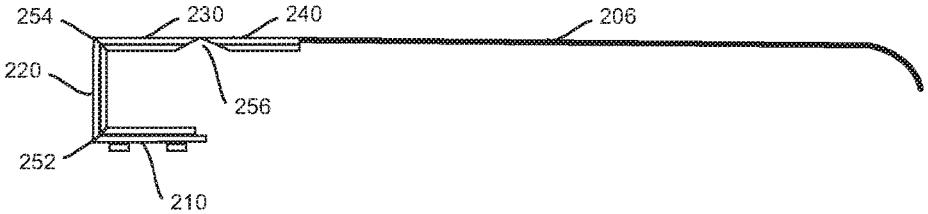
Figure 2D:
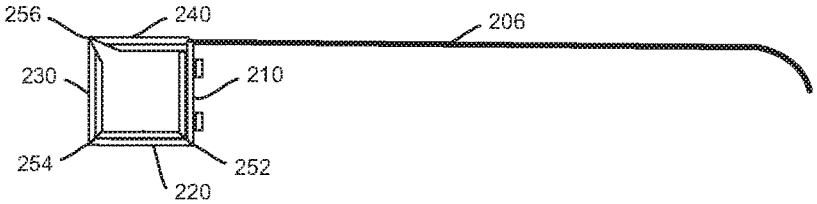

As illustrated in FIGS. 2A-2D, an embodiment of the bridge adapter may fold or bend into a rectangular tube shape. In FIG. 2A, the bridge adapter is fully unfolded and top plate 110, first side plate 120, bottom plate 130, and second side plate 140 are substantially coplanar. Tail 106 is also substantially coplanar with the four plates. The fully unfolded configuration of the bridge adapter may be used for storage or transport. FIG. 2B shows top plate 110 folded at an approximately 90 degree angle to first side plate 120. First hinge 152 is folded to produce this folded configuration. FIG. 2C shows first side plate 120 folded at an approximately 90 degree angle to bottom plate 130, with second hinge 154 being folded. Finally, FIG. 2D shows third hinge 156 folded as bottom plate 130 is folded at an approximately 90 degree angle to second side plate 140. After all the hinges are folded and the plates form roughly 90 degree angles with respect to each other, top plate 110 is locked into the second side plate 140 and the bridge adapter assumes a rectangular tube shape. The locking may happen by the locking indent 119 snapping into the locking feature 107. After the bridge adapter is locked into a rectangular tube shape, tail 106 may be detached.

Since the bridge adapter is a rectangular tube shape when folded, it will be understood that the first side plate and the second side plate are preferably the same width and that the top plate and bottom plate are preferably the same width (not necessarily the same as that of the first and second side plates). Different sizes of the bridge adapter may be available for differently sized locks and differently sized cavities. While the bridge adapter may be made of any material as long as it is sufficiently rigid to bear the weight of the bridge and the lock, in an embodiment, the bridge adapter is made of a polymeric material such as ABS, HDPE, or a similar rigid polymeric material. The first hinge, second hinge, and third hinge are preferably living hinges.

Figure 3A:
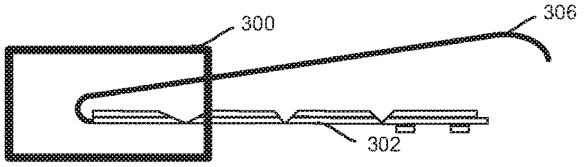
FIGS. 3A-3C are illustrative representations of cross-sectional views of a method for installing a bridge adapter in accordance with embodiments of the present invention.
Figure 3B:
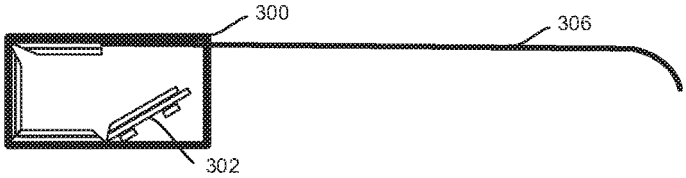
Figure 3C:
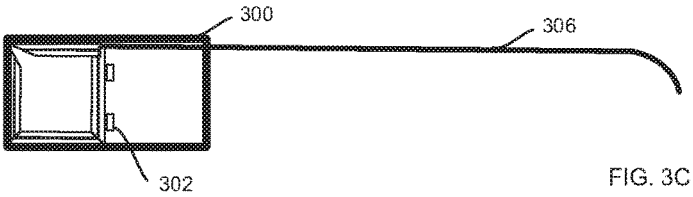

As illustrated in FIGS. 3A-3C, bridge adapter embodiments may be inserted though an opening into cavity 300 within a door stile. Tail 306 may be used to insert the bridge adapter through an opening into cavity 300, as shown in FIG. 3A. After body 302 is partially inserted into cavity 300, as shown in FIG. 3B, the second and third hinge of the bridge adapter may be bended in such a way that the first side plate comes in contact with a wall of the cavity; the bottom plate comes in contact with the bottom of the cavity; and the second side plate comes in contact with another wall of the cavity as shown. In embodiments, the first hinge and the second hinge have a range of motion of more than approximately 90 degrees. In an embodiment, the third hinge has a range of motion of at least approximately 120 degrees to enable the bottom plate front edge and first side plate back edge to clear the wall of the cavity as the bridge adapter folds into position. In some embodiments, the third hinge has a range of motion at least approximately 130 degrees.

As illustrated in FIG. 3C, the top plate of bridge adapter 302 is placed into position. In an embodiment, sufficient pressure may be applied to the top plate to engage the locking indent with the raised locking feature. In an embodiment, the tail may be detached after the bridge adapter is installed. The tail may be useful in positioning bridge adapter embodiments after the locking indent engages with the raised locking feature. The tail may be detached by any method known in the art such as by cutting or by tearing along a perforation.

Figure 4A:
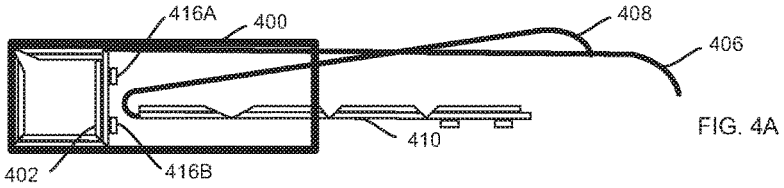
FIGS. 4A-4C are illustrative representations of cross-sectional views of a method for installing two bridge adapters in accordance with embodiments of the present invention.
Figure 4B:
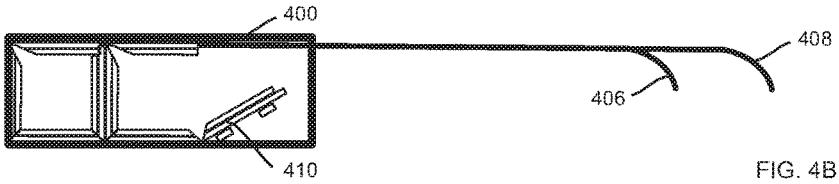
Figure 4C:
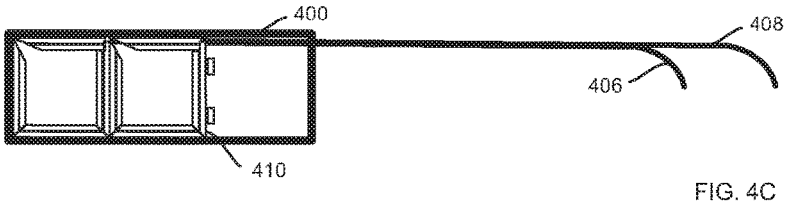

It may be appreciated that in some examples, a cavity may be encountered that is deeper than one bridge adapter can accommodate. In such examples, a second bridge adapter may be needed. In an embodiment, a second bridge adapter may be installed on top of a first bridge adapter, as shown in FIGS. 4A-4C. As illustrated in FIG. 4A, a second bridge adapter may be inserted into cavity 400 into which a first bridge adapter is already installed. It may be noted that the tail of the first bridge adapter is not detached but passes along a cutout. In embodiments, both tails are detached only after both bridge adapters are installed. As noted above, tails may be useful in positioning bridge adapters after locking. In other embodiments, the tail of the first bridge adapter may be detached before the second bridge adapter is installed.

As shown in FIG. 4B, the second bridge adapter may be installed in a manner similar to the first bridge adapter as shown in FIG. 3B. Similarly to FIG. 3B, the second and third hinge of the bridge adapter may be hinged in such a way that the first side plate comes in contact with a wall of the cavity; the bottom plate comes in contact with the bottom of the cavity; and the second side plate comes in contact with another wall of the cavity as shown. In embodiments, the first hinge and the second hinge have a range of motion of more than approximately 90 degrees. In an embodiment, the third hinge has a range of motion of at least approximately 120 degrees to enable the bottom plate front edge and first side plate back edge to clear the wall of the cavity as the bridge adapter folds into position. In some embodiments, the third hinge has a range of motion of at least approximately 130 degrees. Raised features 416A and 416B of the top plate of first bridge adapter 402 may engage the through holes (see FIG. 1, 132A and 132B) of the bottom plate of second bridge adapter 410, locking the second bridge adapter into place.

FIG. 4C illustrates the next stage of the installation of second bridge adapter 410. As illustrated, after the bottom plate of the second bridge adapter is in contact with the top plate of the first bridge adapter and the first and second side plates of the second bridge adapter are in contact with the walls of the cavity, the first hinge is folded or bent to an approximately 90 degree angle by applying pressure to the top plate of the second bridge adapter. The pressure may be applied until the locking indent engages with the raised locking feature and the second bridge adapter is locked in place. In an embodiment, the tails of both bridge adapters may be detached after installation. The tail may be useful in positioning bridge adapter embodiments after the locking indent engages with the raised locking feature. The tail may be detached by any method known in the art such as by cutting or by tearing along a perforation. In an embodiment, one or both of the side plates includes a cutout of an approximate size and shape to accommodate the passage of a tail disposed along an outer surface of bridge adapter 400 (see FIG. 1A, 126). This enables the second bridge adapter to be installed on top of a first bridge adapter without detaching the tail of the first bridge adapter.

Figure 5:
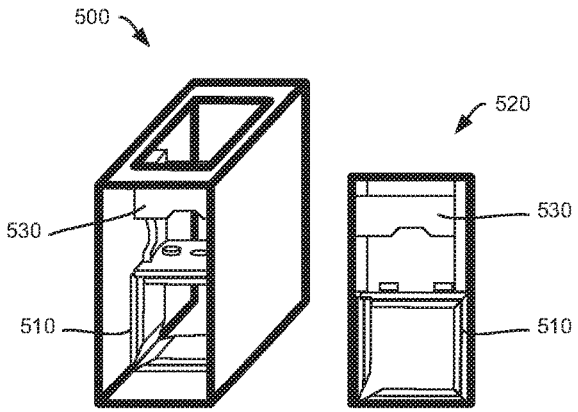
FIG. 5 is an illustrative representation an installed bridge adapter and bridge in accordance with embodiments.
Figure 6:
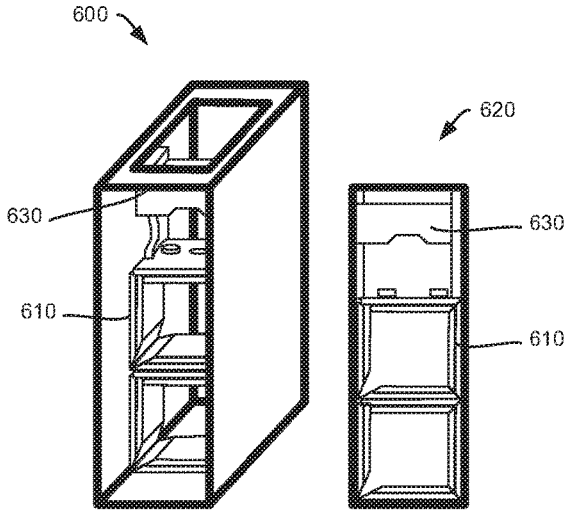
FIG. 6 is an illustrative representation of two installed bridge adapters and bridge in accordance with embodiments of the present invention.

FIGS. 5 and 6 installed bridge adapter embodiments and bridges in accordance with embodiments of the present invention. As utilized herein, a bridge is a structure which can support a mortise lock or faceplate. FIG. 5 illustrates bridge adapter 510 installed in door stile 500. Bridge 530 may be coupled with bridge adapter 510 as shown. In embodiments, a mortise lock or faceplate may then be coupled with and supported by bridge 530. In some examples, a door stile may require an additional bridge adapter. Thus, as illustrated in FIG. 6, bridge adapter 610 may be installed in door stile 600. Bridge 630 may be coupled with bridge adapter 610 as shown. In embodiments, a mortise lock or faceplate may then be coupled with and supported by bridge 630

As can be seen in FIGS. 5 and 6, the tails of the bridge adapters may be removed after installation. In an embodiment, the tail is connected with the body using a perforated living hinge that may be detached without special tools. In alternate embodiments, the tail may be made of a separate piece of material and attached to the body using adhesives or a fastener.

The terms "certain embodiments", "an embodiment", "embodiment", "embodiments", "the embodiment", "the embodiments", "one or more embodiments", "some embodiments", and "one embodiment" mean one or more (but not all) embodiments unless expressly specified otherwise. The terms "including", "comprising", "having" and variations thereof mean "including but not limited to", unless expressly specified otherwise. The enumerated listing of items does not imply that any or all of the items are mutually exclusive, unless expressly specified otherwise. The terms "a", "an" and "the" mean "one or more", unless expressly specified otherwise.

While this invention has been described in terms of several embodiments, there are alterations, permutations, and equivalents, which fall within the scope of this invention. It should also be noted that there are many alternative ways of implementing the methods and apparatuses of the present invention. Furthermore, unless explicitly stated, any method embodiments described herein are not constrained to a particular order or sequence. Further, the Abstract is provided herein for convenience and should not be employed to construe or limit the overall invention, which is expressed in the claims. It is therefore intended that the following appended claims be interpreted as including all such alterations, permutations, and equivalents as fall within the true spirit and scope of the present invention.

What is claimed is:

1. A bridge adapter configured for insertion into a cavity within a door stile, the bridge adapter comprising:

a planar body including, a top plate disposed along a distal end of the planar body, wherein the top plate includes a top plate front edge disposed along the distal end and a top plate back edge located opposite the top plate front edge, wherein the top plate further includes at least one raised feature along a top surface of the top plate, and wherein the top plate front edge includes a locking indent sized to couple with the raised locking feature, a first side plate including a first side plate front edge and a first side plate back edge located opposite the first side plate front edge, wherein the first side plate is mechanically coupled along the first side plate front edge and the top plate back edge by a first hinge, a bottom plate including a bottom plate front edge and a bottom plate back edge located opposite a bottom plate front edge, wherein the bottom plate front edge is mechanically coupled along the first side plate back edge and the bottom plate front edge by a second hinge, wherein the bottom plate includes at least one through hole sized to receive the at least one raised feature, and a second side plate including a second side plate front edge and a second side plate back edge located opposite the second side plate front edge, wherein the second side plate front edge is mechanically coupled along the bottom plate back edge and the second side plate front edge by a third hinge; and a tail including a first end and a second end, wherein the tail is mechanically and removably coupled along the second side plate back edge and the first end, wherein the tail further comprises a raised locking feature, the locking feature disposed along the first end.

2. The bridge adapter of claim 1, wherein the planar body and the tail are made of a polymeric material and wherein the first hinge, second hinge, and third hinge are living hinges.

3. The bridge adapter of claim 1, wherein at least one plate comprises at least one support rib disposed along an inner surface of the at least one plate.

4. The bridge adapter of claim 1, wherein the tail further includes a handle disposed along the second end.

5. The bridge adapter of claim 4, wherein the handle is curved.

6. The bridge adapter of claim 1, wherein the tail is flexible.

7. The bridge adapter of claim 1, wherein the tail is connected to the second side back edge by a perforated feature for detaching the tail.

8. The bridge adapter of claim 1, wherein the first hinge and second hinge have a range of motion of more than approximately 90 degrees and wherein the third hinge has a range of motion of at least approximately 120 degrees.

9. The bridge adapter of claim 8, wherein the third hinge has a range of motion of at least approximately 130 degrees.

10. The bridge adapter of claim 1, wherein the bottom plate is substantially the same width as the cavity, wherein at least one of the first side plate and the second side plate comprises a friction-enhancing feature for engaging a wall of the cavity, and wherein the friction enhancing feature is raised and disposed along an outer surface of the bottom plate.

11. The bridge adapter of claim 1, wherein the second side plate comprises a cutout sized to enable a tail to pass around the bridge adapter, wherein the cutout is disposed along an outer surface of the second side plate.

12. The bridge adapter of claim 1, wherein the top plate further comprises a through hole centered with the top plate.

13. A method of installing a first bridge adapter in a cavity comprising:

providing the first bridge adapter, wherein the first bridge adapter comprises:

a planar body including, a top plate disposed along a distal end of the planar body, wherein the top plate includes a top plate front edge disposed along the distal end and a top plate back edge located opposite the top plate front edge, wherein the top plate further includes at least one raised feature along a top surface of the top plate, and wherein the top plate front edge includes a locking indent, a first side plate including a first side plate front edge and a first side plate back edge located opposite the first side plate front edge, wherein the first side plate is mechanically coupled along the first side plate front edge and the top plate back edge by a first hinge, a bottom plate including a bottom plate front edge and a bottom plate back edge located opposite a bottom plate front edge, wherein the bottom plate front edge is mechanically coupled along the first side plate back edge and the bottom plate front edge by a second hinge, wherein the bottom plate includes at least one through hole sized to receive the at least one raised feature, and a second side plate including a second side plate front edge and a second side plate back edge located opposite the second side plate front edge, wherein the second side plate front edge is mechanically coupled along the bottom plate back edge and the second side plate front edge by a third hinge; and a tail including a first end and a second end, wherein the tail is mechanically and removably coupled along the second side plate back edge and the first end, wherein the tail further comprises a raised locking feature sized to couple with the locking indent, the locking feature disposed along the first end;

inserting the first bridge adapter into the cavity through the opening;

bending the second hinge and third hinge of the first bridge adapter in such a way that the first side plate is in contact with a first wall of the cavity, the bottom plate is in contact with the bottom of the cavity, and the second side plate is in contact with a second wall of the cavity; and bending the first hinge of the first bridge adapter such that the locking indent engages with the raised locking feature.

14. The method of claim 13, further comprising:

detaching the tail after the locking indent engages with the raised locking feature.

15. The method of claim 13, further comprising:

providing a second bridge adapter;

inserting a second bridge adapter into the cavity inserting the second bridge adapter into the cavity through the opening;

bending the second hinge and third hinge of the second bridge adapter in such a way that the first side plate is in contact with a first wall of the cavity, the bottom plate is in contact with the top plate of the first bridge adapter, and the second side plate is in contact with a second wall of the cavity;

engaging the at least one raised feature of the first bridge adapter into the at least one through hole of the second bridge adapter; and bending the first hinge of the second bridge adapter such that the locking indent engages with the raised locking feature.

16. The method of claim 14, further comprising:

detaching the tail of the first bridge adapter; and detaching the tail of the second bridge adapter.

17. The method of claim 13, wherein the first hinge and second hinge have a range of more than approximately 90 degrees and wherein the third has a range of at least approximately 120 degrees.

18. The method of claim 15, wherein the third hinge has a range of motion of at least approximately 130 degrees.

* * * * *